US008146560B2

(12) United States Patent
Scharp et al.

(10) Patent No.: US 8,146,560 B2
(45) **Date of Patent: *Apr. 3, 2012**

(54) MULTI-PART PISTON FOR AN INTERNAL COMBUSTION ENGINE AND METHOD FOR ITS PRODUCTION

(75) Inventors: Rainer Scharp, Vaihingen (DE); Klaus Keller, Lorch (DE); Volker Weisse, Stuttgart (DE)

(73) Assignee: MAHLE International GmbH, Stuttgart (DE)

( * ) Notice: Subject to any disclaimer, the term of this patent is extended or adjusted under 35 U.S.C. 154(b) by 419 days.

This patent is subject to a terminal disclaimer.

(21) Appl. No.: 12/381,841

(22) Filed: Mar. 17, 2009

(65) Prior Publication Data

US 2010/0108016 A1 May 6, 2010

(30) Foreign Application Priority Data

Nov. 5, 2008 (DE) ..... 10 2008 055 912

(51) Int. Cl.
*F02F 3/22* (2006.01)
*F02F 3/00* (2006.01)

(52) U.S. Cl. ..... 123/193.6; 123/41.35

(58) Field of Classification Search ..... 92/186, 92/216, 219, 222, 231, 255, 256, 258; 29/888.042, 29/888.044; 123/193.6, 41.35
See application file for complete search history.

(56) References Cited

U.S. PATENT DOCUMENTS

| | | | | |
|---|---|---|---|---|
| 4,506,632 | A * | 3/1985 | Kanda et al. | 123/41.35 |
| 5,144,923 | A * | 9/1992 | Leites et al. | 123/193.6 |
| 6,026,777 | A * | 2/2000 | Kemnitz et al. | 123/193.6 |
| 6,453,797 | B1 * | 9/2002 | Bauer | 92/186 |
| 2007/0079775 | A1 * | 4/2007 | Lin et al. | 123/41.35 |

FOREIGN PATENT DOCUMENTS

EP 1 222 364 7/2002

* cited by examiner

*Primary Examiner* — M. McMahon
(74) *Attorney, Agent, or Firm* — Collard & Roe, P.C.

(57) ABSTRACT

The present invention relates to a multi-part piston (10, 110) for an internal combustion engine, having an upper piston part (11, 111) having a piston crown (13), and a lower piston part (12), whereby the lower piston part (12) has pin boss supports (32) and pin bosses (18) connected with them, whereby the upper piston part (11) and the lower piston part (12) each have an inner (21, 25) and an outer (22, 26) support element, which elements delimit an outer circumferential cooling channel (29). According to the invention, it is provided that the inner support elements (21, 25) delimit a cavity (31) that is open toward the pin bosses (18), and that the cavity (31) is provided with a separate cooling oil collector (35, 135) that has at least one cooling oil opening (37, 38). The present invention furthermore relates to a method for the production of such a piston.

15 Claims, 1 Drawing Sheet

MULTI-PART PISTON FOR AN INTERNAL COMBUSTION ENGINE AND METHOD FOR ITS PRODUCTION

CROSS REFERENCE TO RELATED APPLICATIONS

Applicants claim priority under 35 U.S.C. §119 of German Application No. 10 2008 055 912.1 filed on Nov. 5, 2008.

BACKGROUND OF THE INVENTION

1. Field of the Invention

Page 1, after the first paragraph, please add the following:

2. The Prior Art

The present invention relates to a multi-part piston for an internal combustion engine, having an upper piston part that has a piston crown, and a lower piston part, whereby the lower piston part has pin boss supports and pin bosses connected with them, whereby the upper piston part and the lower piston part each have an inner and an outer support element, which elements delimit an outer circumferential cooling channel. The present invention furthermore relates to a method for the production of such a piston.

A multi-part piston is disclosed, for example, in EP 1 222 364 B1. This piston has an outer circumferential cooling channel and an inner cooling chamber whose cooling chamber bottom is provided with an opening. This opening serves to allow cooling oil to flow away out of the inner cooling chamber in the direction of the piston crown, in order to lubricate the piston pin and to intensify the cooling effect by means of effective cooling oil circulation. In order to achieve this goal, the opening in the cooling chamber bottom is not allowed to be chosen to be too large, because then, the cooling oil would no longer flow away in metered manner, and effective cooling oil circulation would thereby be impaired. This means that the cooling chamber bottom is configured essentially as a relatively wide and thin circumferential ring land that extends approximately in the radial direction, in the upper region of the lower piston part. However, such a structure is difficult to produce. In the case of a forged lower piston part, in particular, there is the additional problem that when using a forging method, only a very thick and heavy cooling chamber bottom can be produced, due to forging tolerances and production restrictions.

SUMMARY OF THE INVENTION

The task of the present invention consists in making available a multi-part piston as well as a method for its production, which guarantees a good cooling effect of the cooling oil as well as effective lubrication of the piston pin, and, at the same time, is as simple as possible to produce as a light piston, also in the form of a forged piston.

The solution consists in a piston that has inner support elements that delimit a cavity that is open toward the pin bosses, wherein the cavity is provided with a separate cooling oil collector that has at least one cooling oil opening. The method according to the invention is characterized by the following method steps: producing an upper piston part having a piston crown as well as an inner and an outer support element; producing a lower piston part having pin boss supports and pin bosses connected with them, as well as having an inner and an outer support element; inserting a separate cooling oil collector, having at least one cooling oil opening, into the upper piston part or the lower piston part; connecting the upper piston part and the lower piston part in such a manner that the inner and outer support elements, in each instance, delimit an outer circumferential cooling channel and a cavity that is open toward the pin bosses and provided with the cooling oil collector.

According to the invention, an inner cooling chamber and thus a cooling chamber bottom in the piston are therefore eliminated. The problem of producing a circumferential ring land that extends approximately in the radial direction, as a relatively wide and thin region, is therefore completely eliminated. The upper piston part and the lower piston part of the piston according to the invention can therefore also be produced as forged parts, in relatively simple manner, and as comparatively light components. The piston according to the invention and the production method according to the invention are thus also characterized by clearly improved economic efficiency. In this connection, the cooling oil collector serves to optimize the cooling effect of the cooling oil, particularly below the piston crown. The at least one cooling oil opening in the cooling oil collector provided according to the invention also allows significantly better and more precise metering of the cooling oil that flows away in the direction of the piston pin, so that the lubrication of the piston pin is also improved, as compared with the pistons known in the state of the art. Since the cooling oil collector can be produced and installed as a very simply structured and light component, the economic efficiency of the piston according to the invention, and of the production method according to the invention, remains unimpaired.

Advantageous further developments are evident from the dependent claims.

A preferred embodiment of the piston according to the invention consists in that the cooling oil collector is held or rests against the lower piston part in the region of the inner support element. The cooling oil collector can lie on the pin boss supports in this position, and is thereby additionally fixed in place.

A preferred embodiment provides that a holder element that extends from the underside of the piston crown, vertically in the direction of the lower piston part, is provided in the cavity, against which the cooling oil collector rests in the axial direction, with force fit and/or shape fit. With this measure, as well, additional fixation of the holder element in the direction of the piston axis is achieved.

For this purpose, the cooling oil collector can have a hat-shaped elevation that interacts with the holder element. This elevation imparts additional stability to the cooling oil collector.

The holder element can be formed onto the underside of the piston crown, in one piece with it. However, it can also be configured as a separate component and be held on the underside of the piston crown with force fit and/or shape fit. The selection is up to the discretion of the person skilled in the art, and allows flexible adaptation of the piston properties to the requirements in operation, in each instance.

If the holder element is configured as a separate component, it can be pressed against the underside of the piston crown after assembly of the piston according to the invention, for example, or be connected with the underside of the piston crown using a pin connection or screw connection. These construction methods are particularly simple to implement.

Independent of how the holder element is connected to the underside of the piston crown, the end of the holder element that faces the lower piston part can have a circumferential contact shoulder that surrounds a projection, for example, which shoulder rests on the cooling oil collector, whereby the projection engages into a bore provided in the cooling oil collector. The projection can be configured as a stud, and the holder element can be riveted to the cooling oil collector by means of this stud. In the case of this embodiment, the shape-fit connection of holder element and cooling oil collector results in a particularly reliable, stable hold.

It is practical if the length of the holder element is dimensioned in such a way that the cooling oil collector is supported firmly on the inner support element and/or on the pin boss connection, and thus no longer has any lateral play. In this way, the cooling oil collector is positioned particularly firmly in the lower piston part.

For the purpose of further stabilization of the cooling oil collector, the latter can have an at least partially circumferential flange, which lies against the inner support element and brings about an additional friction grip.

It is practical if the cooling oil collector is held under spring bias, whereby the length of the holder element is dimensioned accordingly. In this case, in particular, the cooling oil collector can be configured as an at least partially spring-elastic component. A possible configuration of such a cooling oil collector consists in that the cooling oil collector has an at least partially circumferential spring-elastic flange or at least two elastic spring tongues disposed on the outer edge. In the latter case, the slits that delimit the spring tongues can serve as cooling oil openings, at the same time.

In the simplest case, the cooling oil collector has an essentially round shape, and can be provided with a slight curvature.

The at least one cooling oil opening in the cooling oil collector can be configured as a usual round opening, or, for example, also as a slit disposed on the edge of the cooling oil collector, or a slit that extends from the edge of the cooling oil collector inward. Preferably, the cooling oil collector has two or more cooling oil openings, so that a very precisely metered amount of cooling oil can flow away out of the cavity, in the direction of the piston pin.

The cooling oil collector can be produced from any desired material, whereby a spring steel sheet has proven to be well suited.

The upper piston part and/or the lower piston part can be cast parts or forged parts, and can be produced, for example, from a steel material, particularly forged. The connection between upper piston part and lower piston part can take place in any desired manner. Welding, particularly friction welding, is possible as a particularly well suited joining method.

An exemplary embodiment of the present invention will be explained in greater detail below, using the attached drawings. These show, in a schematic representation, not to scale:

BRIEF DESCRIPTION OF THE DRAWINGS

Other benefits and features of the present invention will become apparent from the following detailed description considered in connection with the accompanying drawings. It is to be understood, however, that the drawings are designed as an illustration only and not as a definition of the limits of the invention.

In the drawings, similar reference characters denote similar elements throughout the several views.

DETAILED DESCRIPTION OF THE DRAWINGS

Figure 1:
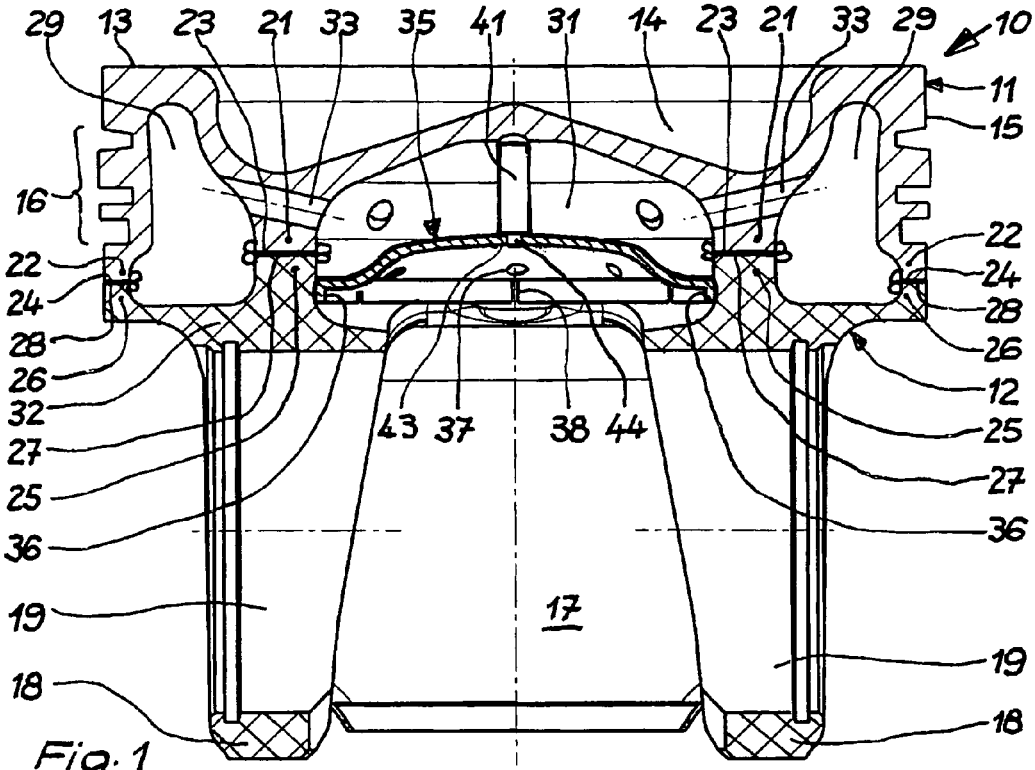
FIG. 1 a section through a first exemplary embodiment of a piston according to the invention.

FIG. 1 shows a first exemplary embodiment of a piston 10 according to the invention. The piston 10 according to the invention is composed of an upper piston part 11 and a lower piston part 12, which, in the exemplary embodiment, are forged from a steel material. The upper piston part 11 has a piston crown 13 having a combustion bowl 14, as well as a circumferential top land 15 and a circumferential ring belt 16. The lower piston part 12 has a piston skirt 17 and pin bosses 18 having pin bores 19, for accommodating a piston pin (not shown).

The upper piston part 11 has an inner support element 21 and an outer support element 22. The inner support element 21 is disposed on the underside of the piston crown 13, circumferentially, in ring shape, and has a joining surface 23. The outer support element 22 of the upper piston part 11 is formed below the ring belt 16, in the exemplary embodiment, and has a joining surface 24.

The lower piston part 12 also has an inner support element 25 and an outer support element 26. The inner support element 25 is disposed on the top of the lower piston part 12, circumferentially, and has a joining surface 27. The outer support element 26 is formed as an extension of the piston skirt 17 in the exemplary embodiment, and has a joining surface 28. Pin boss supports 32 for connecting the pin bosses 18 are provided below the inner support element 25 of the lower piston part 12.

The upper piston part 11 and the lower piston part 12 can be joined together in any desired manner, whereby the joining surfaces 23 and 27, and 24 and 28, respectively, are connected with one another. In the exemplary embodiment, the upper piston part 11 and the lower piston part 12 were welded together.

The upper piston part 11 and the lower piston part 12 form an outer circumferential cooling channel 29. In this connection, the ring belt 16 and the outer support element 22 of the upper piston part 11 as well as the outer support element 26 of the lower piston part 12 delimit the outer cooling channel 29 toward the outside. The inner support element 21 of the upper piston part 11 and the inner support element 25 of the lower piston part 12 delimit the outer cooling channel 29 toward the piston interior. The inner support element 21 of the upper piston part 11 and the inner support element 25 of the lower piston part 12 furthermore delimit a cavity 31 that is open toward the pin bosses 18, which cavity is disposed essentially below the piston crown 13.

In the exemplary embodiment, cooling oil channels 33 are provided in the inner support element 21 of the upper piston part 11, which connect outer cooling channel 29 with the cavity 31. In the exemplary embodiment, the cooling oil channels 33 run at an angle downward, in the direction of the cavity 31, proceeding from the outer cooling channel 29. Of course, the cooling oil channels can also be disposed, exclusively or additionally, in the inner support element 25 of the lower piston part 12, and/or can run at an angle upward, in the direction of the cavity 31, proceeding from the outer cooling channel 29.

The cavity 31 is provided with a cooling oil collector 35. In the exemplary embodiment, the cooling oil collector 35 is produced from a spring steel sheet, has an essentially round shape, is provided with a slight curvature, and has a thickness of approximately 0.8 mm. In the exemplary embodiment, it has a circumferential spring-elastic flange 36 and cooling oil openings 37. In the exemplary embodiment, the flange 36 is provided with slits 38 that both increase the elasticity of the flange 36 in the radial direction and also serve as additional cooling oil openings. Furthermore, in the exemplary embodiment, the cooling oil collector 35 is disposed in such a manner that its curvature is oriented toward the upper piston part 11.

A holder element 41, which is configured as a separate component, and, in the exemplary embodiment, consists of a metallic material, projects, in the exemplary embodiment, vertically in the direction of the lower piston part 12, into the cavity 31, proceeding from the underside of the piston crown 13, in the center axis M of the piston 10. At its free end, which projects into the cavity 31, the holder element 41 has a projection 44 that is surrounded by a circumferential contact shoulder. The projection 44 passes through a center bore 43 provided in the cooling oil collector 35, whereby the contact shoulder lies on the top of the cooling oil collector 35. In the exemplary embodiment, the projection 44 is configured as a stud, and the holder element 41 is riveted to the cooling oil collector 35 by means of this stud. At its free end, facing the piston crown 13, the holder element 41 lies firmly against the underside of the piston crown 13. In the exemplary embodiment, the length of the holder element 41 is dimensioned in such a manner that the cooling oil collector 35 is supported on the inner support element 25, or on the pin boss supports 32, respectively, under spring bias, whereby the flange 26 lies against the inner support element 25 and brings about an additional friction grip between cooling oil collector 35 and lower piston part 12. Thus, the cooling oil collector 35 is held particularly securely and without play.

The cooling oil collector 35 serves to collect the cooling oil that passes through the cooling oil channels 33, out of the outer cooling channel 29, into the cavity 31, and to guide it in the direction of the underside of the piston crown 13, particularly by means of the shaker effect that occurs during operation, in order to increase the cooling effect in this region. The cooling oil openings 37, 38 make it possible to guide a defined amount of cooling oil in the direction of the piston pin (not shown) accommodated in the pin bores 19, in order to improve its lubrication.

For assembly of the piston 10 according to the invention, first the upper piston part 11, the lower piston part 12, the cooling oil collector 35, and the holder element 41 are produced as separate components. Then the holder element 41 is riveted to the cooling oil collector. In the exemplary embodiment, the cooling oil collector 35 is inserted into the lower piston part 12, in the region of the inner circumferential support element 25, and held there under spring bias, with force fit. Subsequently, the upper piston part 11 and the lower piston part 12 are connected with one another, by means of a joining method that can be selected as desired, by way of the joining surfaces 23, 27 and 24, 28, respectively, in such a manner that the cooling oil collector 35 is accommodated in the cavity 31, in the finished piston, and the holder element 41 is pressed against the underside of the piston crown 13, so that it is held with force fit there. For stabilization, a recess, for example a recess in the shape of a flattened dome or a cone, can be provided in the underside of the piston crown 13, into which recess the holder element 41 engages.

Figure 2:
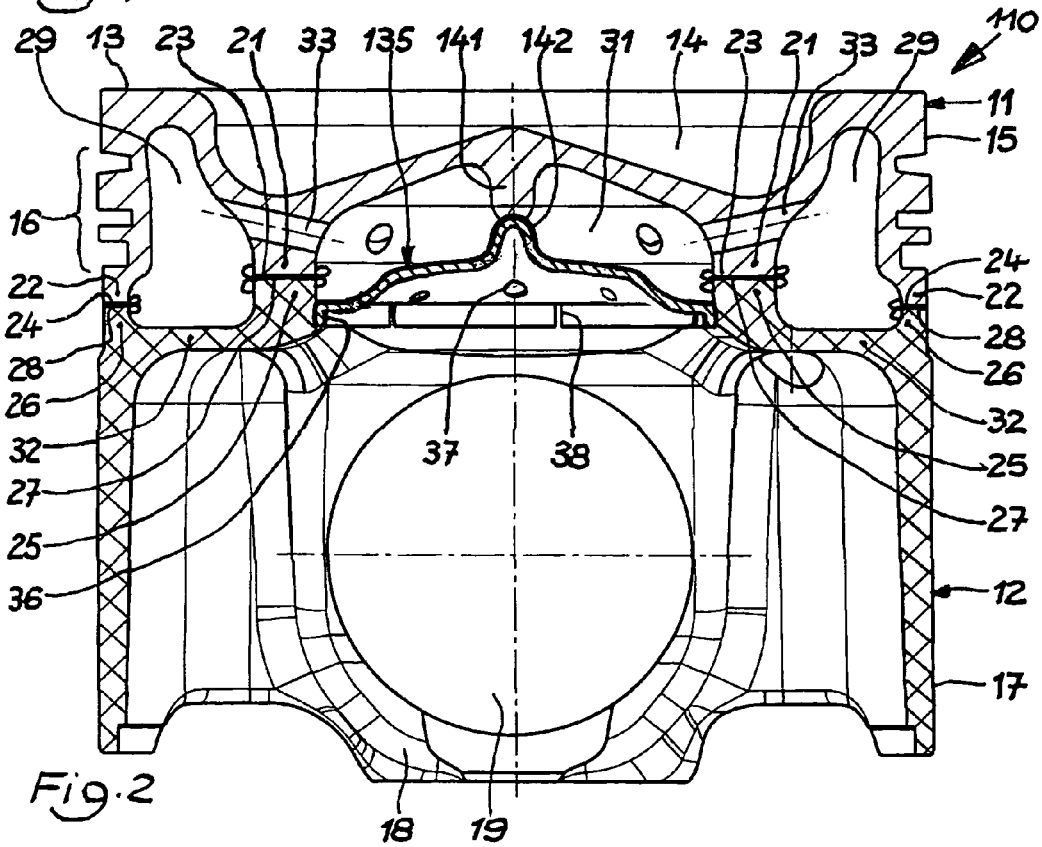
FIG. 2 a section through another exemplary embodiment of a piston according to the invention.

FIG. 2 shows another exemplary embodiment of a piston 110 according to the invention. The piston 110 has essentially the same construction as the piston 10 according to FIG. 1, so that the same structures are provided with the same reference symbols, and reference is made to the description of FIG. 1 with regard to these reference symbols.

A significant difference as compared with the piston 10 according to FIG. 1 consists in that in the case of the piston 110, the holder element 141 on the upper piston part 111 is formed onto the underside of the piston crown 13, in one piece with it. Furthermore, the cooling oil collector 135 has a hat-shaped elevation 142 that interacts with the free end of the holder element 141. In the exemplary embodiment, the length of the holder element 141 is dimensioned in such a manner that the cooling oil collector 135 is supported on the inner support element 25, or on the pin boss supports 32, respectively, under spring bias, whereby the flange 26 lies against the inner support element 25 and brings about an additional friction grip between cooling oil collector 135 and lower piston part 12. In this way, the cooling oil collector 135 is held particularly securely and without play.

Of course, in the two embodiments, the cooling oil collector can also consist of a non-resilient, preferably metallic material, and be held in the lower piston part 12 with force fit.

Furthermore, after prior cleaning and degreasing, the flange region 36 of the cooling oil collector 35 can also be provided with a layer of solder tin, for example a copper tin solder or silver solder (AgSn), applied in a layer thickness of 100-500 μm, by means of dabber printing or screen printing, or by means of immersion in a solder bath.

For assembly of the piston 110 according to the invention, first the upper piston part 111 with the holder element 141 formed on in one piece, the lower piston part 12, and the cooling oil collector 135 are produced as separate components. In the exemplary embodiment, the cooling oil collector 135 is inserted into the lower piston part 12 in the region of the inner circumferential support element 25, and held under spring bias there, with force fit. Subsequently, the upper piston part 111 and the lower piston part 12 are connected with one another, using a joining method that can be selected as desired, by way of the joining surfaces 23, 27 and 24, 28, respectively, in such a manner that the cooling oil collector 135 is accommodated in the cavity 31, in the finished piston, and the holder element 141 is pressed against the hat-shaped elevation 142 of the cooling oil collector 135.

If the flange region of the cooling oil collector 35 has been provided with solder paste, melting of the solder layer takes place as a result of the heat that forms during the friction welding process, so that the cooling oil collector is additionally fixed in place on the piston part (12).

The inner cooling chamber with the cooling chamber bottom in the form of a wide, radially circumferential ring land, which is required in the state of the art, has therefore been eliminated in both embodiments.

The invention claimed is:

1. A multi-part piston for an internal combustion engine, comprising:

an upper piston part comprising a piston crown, a first inner support element, and a first outer support element, and a lower piston part, a lower piston part comprising a second inner support element, a second outer support element, pin boss supports and pin bosses connected with said pin boss supports, wherein said first and second inner support elements and first and second outer support elements delimit an outer circumferential cooling channel, wherein said first and second inner support elements delimit a cavity that is open toward the pin bosses, and wherein said cavity is provided with a separate cooling oil collector, said separate cooling oil collector having at least one cooling opening wherein a holder element extends vertically in the cavity in a direction of the lower piston part, from an underside of the piston crown, wherein the cooling oil collector is supported against the holder element in an axial direction, with at least one of a force fit and a shape fit, wherein an end of the holder element that projects into the cavity has a circumferential contact shoulder that surrounds a projection, said shoulder resting on the cooling oil collector, and wherein the projection engages into a bore provided in the cooling oil collector.

2. The piston according to claim 1, wherein said oil collector is held or lies against the lower piston part in a region of the second inner support element.

3. The piston according to claim 1, wherein the cooling oil collector has a hat-shaped elevation that interacts with the holder element.

4. The piston according to claim 1, wherein the holder element is formed onto the underside of the piston crown, in one piece with the piston crown.

5. The piston according to claim 1, wherein the holder element is configured as a separate component and held on the underside of the piston crown with at lest one of a force fit and shape fit.

6. The piston according to claim 5, wherein the projection is configured as a stud, and the holder element is riveted to the cooling oil collector.

7. The piston according to claim 1, wherein a length of the holder element is dimensioned in such a manner that the cooling oil collector is supported on at least one of the inner support elements and the pin boss supports.

8. The piston according to claim 1, wherein the cooling oil collector has an at least partially circumferential flange, said flange lying against the second inner support element.

9. The piston according to claim 1, wherein the cooling oil collector is configured as an at least partially spring-elastic component.

10. The piston according to claim 9, wherein the cooling oil collector has an at least partially circumferential spring-elastic flange.

11. The piston according to claim 1, wherein the cooling oil collector is configured in an essentially round shape.

12. The piston according to claim 1, wherein the cooling oil collector has a slight curvature.

13. The piston according to claim 1, wherein the at least one cooling oil opening in the cooling oil collector is configured as a slit disposed at an edge of the cooling oil collector.

14. The piston according to claim 1, wherein the cooling oil collector has two or more cooling oil openings.

15. The piston according to claim 1, wherein the cooling oil collector is produced from a spring steel sheet.

* * * * *